US007351002B2

(12) United States Patent
Yodock, III et al.

(10) Patent No.: US 7,351,002 B2
(45) Date of Patent: Apr. 1, 2008

(54) BARRIER DEVICE WITH EXTERNAL REINFORCEMENT STRUCTURE

(76) Inventors: Leo J. Yodock, III, 1775 Fifth Street Hollow, Bloomsburg, PA (US) 17815; Leo J. Yodock, 623 NE. 5th Ter., Fort Lauderdale, FL (US) 33304; Guy C. Yodock, 623 NE. 5th Ter., Fort Lauderdale, FL (US) 33304

( * ) Notice: Subject to any disclaimer, the term of this patent is extended or adjusted under 35 U.S.C. 154(b) by 361 days.

(21) Appl. No.: 11/082,630

(22) Filed: Mar. 17, 2005

(65) Prior Publication Data

US 2005/0254892 A1 Nov. 17, 2005

Related U.S. Application Data

(60) Continuation-in-part of application No. 10/669,998, filed on Sep. 24, 2003, now abandoned, which is a division of application No. 10/033,974, filed on Dec. 19, 2001, now Pat. No. 6,666,616.

(51) Int. Cl.
*E01F 13/00* (2006.01)

(52) U.S. Cl. ..... 404/6

(58) Field of Classification Search ..... 404/6; 256/13.1

See application file for complete search history.

(56) References Cited

U.S. PATENT DOCUMENTS

| | | | | | |
|---|---|---|---|---|---|
| 3,877,681 | A | * | 4/1975 | Humphrey | 256/64 |
| 4,059,362 | A | | 11/1977 | Smith | 404/6 |
| 4,391,077 | A | | 7/1983 | Giess | 52/747 |
| 4,496,264 | A | * | 1/1985 | Casey | 404/6 |
| 4,681,302 | A | | 7/1987 | Thompson | 256/13.1 |
| 4,773,629 | A | | 9/1988 | Yodock | 256/13.1 |
| 4,946,138 | A | | 8/1990 | Gaillard et al. | 256/13.1 |
| 4,946,306 | A | | 8/1990 | Yodock | 404/6 |
| 5,030,029 | A | | 7/1991 | Johnsen | 404/6 |
| 5,123,773 | A | | 6/1992 | Yodock | 404/6 |
| 5,387,049 | A | | 2/1995 | Duckett | 404/6 |
| 5,425,594 | A | | 6/1995 | Krage et al. | 404/6 |
| 5,498,101 | A | | 3/1996 | Braverman | 404/6 |
| 5,531,540 | A | | 7/1996 | Wasserstrom et al. | 404/6 |
| 5,605,413 | A | | 2/1997 | Brown | 404/6 |
| 5,882,140 | A | | 3/1999 | Yodock et al. | 404/6 |
| 6,164,865 | A | | 12/2000 | McCallum | 404/6 |
| 6,179,516 | B1 | | 1/2001 | Ivey et al. | 404/6 |
| 6,428,237 | B1 | | 8/2002 | Duckett | 404/6 |
| 6,666,616 | B2 | | 12/2003 | Yodock, III et al. | 404/6 |

(Continued)

*Primary Examiner*—Gary S Hartmann
(74) *Attorney, Agent, or Firm*—GrayRobinson, PA

(57) ABSTRACT

A barrier device comprises a top wall, a bottom wall, opposed end walls and opposed side walls interconnected to form a hollow interior in which a pair of spaced openings are formed which extend between the side walls. An external reinforcement structure is provided to enhance the structural integrity of the barrier device, including first and second beams each located along one of the side walls which are connected to one another by a mounting device extending through the openings in the hollow interior, or, alternatively, are mounted within a seat formed in each side wall between the opposed ends of the barrier device. The beams of one barrier device are connected end-to-end with the beams of adjacent barrier devices to form an essentially continuous wall of barriers which resist disengagement from one another and exhibit improved resistance to being broken apart upon impact by a vehicle.

3 Claims, 15 Drawing Sheets

U.S. PATENT DOCUMENTS 6,843,614 B2 * 1/2005 Yodock et al. ..... 404/6
6,848,857 B1 * 2/2005 McColl et al. ..... 404/6
6,863,468 B2 * 3/2005 Davis et al. ..... 404/6
6,951,434 B2 * 10/2005 Yodock et al. ..... 404/6
2004/0057792 A1 * 3/2004 Yodock et al. ..... 404/6

* cited by examiner 10
22
12
136
20
14

10
22
132
130
132
130
14
132
24
134
130
12
132
132
20

122
112
120
122
116
118
114
110

122
112
120
118
110

BARRIER DEVICE WITH EXTERNAL REINFORCEMENT STRUCTURE

RELATED APPLICATION

This application is a continuation-in-part of U.S. patent application Ser. No. 10/669,998, filed Sep. 24, 2003 now abandoned, which is a divisional of U.S. patent application Ser. No. 10/033,974, filed Dec. 19, 2001, now U.S. Pat. No. 6,666,616, issued Dec. 23, 2003 in the name of Leo J. Yodock, III, Leo J. Yodock, Jr., and Guy C. Yodock, entitled "Barrier Device With External Reinforcement."

FIELD OF THE INVENTION

This invention relates to barrier devices for vehicular and vessel traffic control, soil erosion containment, impact attenuation and the like which can be interconnected with one another to define a continuous barrier wall structure and/or connected in various combinations to form energy-absorbing cells, and, more particularly, to barrier devices formed of a light weight plastic having side wall which receive and mount external reinforcement structure in the form of a pair of beams each extending along the length of one of the side walls.

BACKGROUND OF THE INVENTION

A variety of different devices have been developed for absorbing the kinetic energy of impact of colliding automobiles, and for the containment of forces exerted by soil or water. Highway barrier devices, for example, are intended to provide a continuous wall or barrier along the center line of a highway when laid end-to-end to absorb grazing blows from moving vehicles. One commonly used highway barrier is formed of pre-cast reinforced concrete, and is known as the "New Jersey" style barrier. Highway barriers of this type have a relatively wide base including side walls which extend vertically upwardly from the pavement a short distance, then angle inwardly and upwardly to a vertically extending top portion connected to the top wall of the barrier. This design is intended to contact and redirect the wheels of a vehicle in a direction toward the lane of traffic in which the vehicle was originally traveling, instead of the lane of opposing traffic. See U.S. Pat. No. 4,059,362.

One problem with highway barriers of the type described above is the high weight of reinforced concrete. A barrier having a typical length of twelve feet weighs about 2,800-3,200 pounds and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of impact forces, highway barriers have been designed which are formed of a hollow plastic container filled with water, sand or other ballast material such as disclosed in U.S. Pat. Nos. 4,681,302; 4,773,629; 4,846,306, 5,123,773 and 5,882,140. For example, the '302 patent discloses a barrier comprising a container having a top wall, a bottom wall, opposed side walls and opposed end walls interconnected to form a hollow interior which is filled with water, and having fittings for coupling one barrier to another to form a continuous wall. The container structure is formed of a resilient material which is deformable upon impact and capable of resuming its original shape after being struck. Longitudinally extending, spaced traction spoiler channels are said to reduce the area of potential impact and thus the tendency of the vehicle to climb the walls of the barrier and vault over it into the opposing lane of traffic.

The '629, '306, '773 and '140 patents noted above represent further advances in deformable highway barrier designs. The first two patents disclose barriers which comprise a longitudinally extending container made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or the like when laid end-to-end.

The '773 and '140 patents disclose further improvements in barrier devices including side walls formed with higher curb reveals, a horizontally extending step and vertical indentations in order to assist in maintaining the structural integrity of the container, and to create internal baffles for dampening movement of water or other fluid within the container interior. Interlocking male and female coupling elements are formed on opposite end walls of the barrier to facilitate end-to-end connection thereof. Additionally, such barriers are formed with channels or openings to permit the insertion of the tines of a fork lift truck therein for easy handling of the barriers.

Despite the improvements in highway barrier designs noted above, some deficiencies nevertheless remain. One concern has been with the ability of a wall of barriers, e.g. individual barriers connected end-to-end, to withstand a direct impact by a speeding vehicle. It has been found that plastic barriers tend to separate from one another at their connections, and in some instances break apart in response to the vehicle impact. Although concrete barriers of the type described above also can break apart during a crash, they are more resistant to that than plastic barriers and there is a need for plastic barriers to demonstrate impact resistance capabilities which more closely approximates those of concrete barriers.

SUMMARY OF THE INVENTION

This invention is directed to a barrier device comprising a top wall, a bottom wall, opposed end walls, and, opposed side walls interconnected to form a hollow interior in which a pair of spaced openings are formed which extend between the side walls. An external reinforcement structure is provided to enhance the structural integrity of the barrier device, including first and second beams each extending along one of the side walls which are connected to one another by a mounting device extending through the openings, or, alternatively, are mounted within a seat formed in each side wall between the opposed ends of the barrier device. The beams of one barrier device, in turn, are connected end-to-end with the beams of an adjacent barrier device to form an essentially continuous, interconnected wall of barriers which resist disengagement from one another and exhibit improved resistance to being broken apart upon impact by a vehicle.

The openings extending through the hollow interior are fork lift holes which are sized to receive the tines of a fork lift thus facilitating movement of the barrier device during loading, unloading and assembly. In one presently preferred embodiment of this invention, the external reinforcement structure comprises a first box beam and a second box beam, each generally square in cross section and formed of metal, rubber, composite material or the like. Each box beam is hollow, at least at its opposite ends, in order to receive and mount one end of a connector bar whose other end is mounted within the box beam of an adjacent barrier device. The cross section of the connector bar is sufficiently smaller than that of the box beams to permit at least limited pivotal movement of the connector bar within the beams, and hence, pivotal movement between the adjacent barrier devices.

The two box beams are connected to one another by a pair of brackets each including a plate mounted at each edge to one of a pair of upstanding legs. One bracket is inserted within each of the fork lift holes and has a length dimension such that its ends protrude from the side walls. Each box beam rests atop a protruding end of both brackets and is bolted in place to connect it to the bracket and, in turn, to the box beam on the other side wall. Because the brackets have upstanding legs, clearance is provided within each fork lift hole to receive the tines of a fork lift even with the brackets and box beams in place.

In an alternative embodiment, a pair of box beams similar to those noted above are employed except they are connected to one another by telescoping members associated with each beam. One of the box beams mounts a pair of sleeves extending perpendicular thereto, and the other box beam mounts a pair of arms which align with the sleeves and are inserted therein when the beams are positioned along the side walls. The box beams associated with one barrier device are connected to those of an adjacent barrier by means of telescoping ends of the beams. One end of each beam has a reduced cross sectional area which telescopes into the opposite end of an adjacent beam having a larger cross section. The beams of one barrier device may be connected to the beams of an adjacent barrier device by a friction fit, or with fasteners such as bolts.

Additional embodiments of this invention employ "beams" in the form of hollow or solid slats which are mounted within longitudinally extending seats formed in the side walls of each barrier device between the end walls. Connecting structure is provided to mount the protruding ends of each beam of one barrier device to those of an adjacent barrier device.

In each of the embodiments employing a beam or slat structure extending along the opposed side walls of a barrier device, a ground anchor is preferably employed to assist in retaining the barrier device in position on the roadway or other surface on which it rests. The ground anchor(s) are connected to the beam or slat, or the mounting structure for same, and then are staked or otherwise affixed to the ground.

As noted above, a number of barrier devices may be connected end-to-end to form a barrier wall. At the outermost ends of the wall, the beams or slats of the end most barrier devices are exposed and could present a hazard if impacted by oncoming traffic. An end connector is therefore provided in order to close off the beam or slat ends.

In another aspect of this invention, a rotational molding process is employed to combine crosslinkable high density polyethylene material with polyethylene foaming pellets to form the barrier device noted above with walls having an interior surface covered with a layer of foam. The plastic, polyethylene walls have a thickness on the order of about 0.25 inches, and the foam layer is in the range of about 0.5 to 6 inches in thickness depending upon the amount of foaming pellets used. Fill holes are formed in the top wall of the barrier so that water, sand or other ballast material can be introduced into the hollow interior and into contact with the foam layer. In an alternative embodiment, substantially the entire hollow interior of the barrier is filled with foam material. Preferably, a liquid material is introduced into the hollow interior through one or more of the fill holes, which then cures to form a foam which expands to fill all or a part of the entire volume of the barrier interior.

It has been found that barrier devices filled with foam can be interconnected end-to-end to form a barrier wall which readily floats in water, and the external reinforcement structure adds overall strength, rigidity and resistance to separation and breaking apart of individual barriers within such barrier wall. These floating barrier walls can be used in various naval applications to encircle ships or other assets, or to segregate areas within a port or dock area, as desired.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
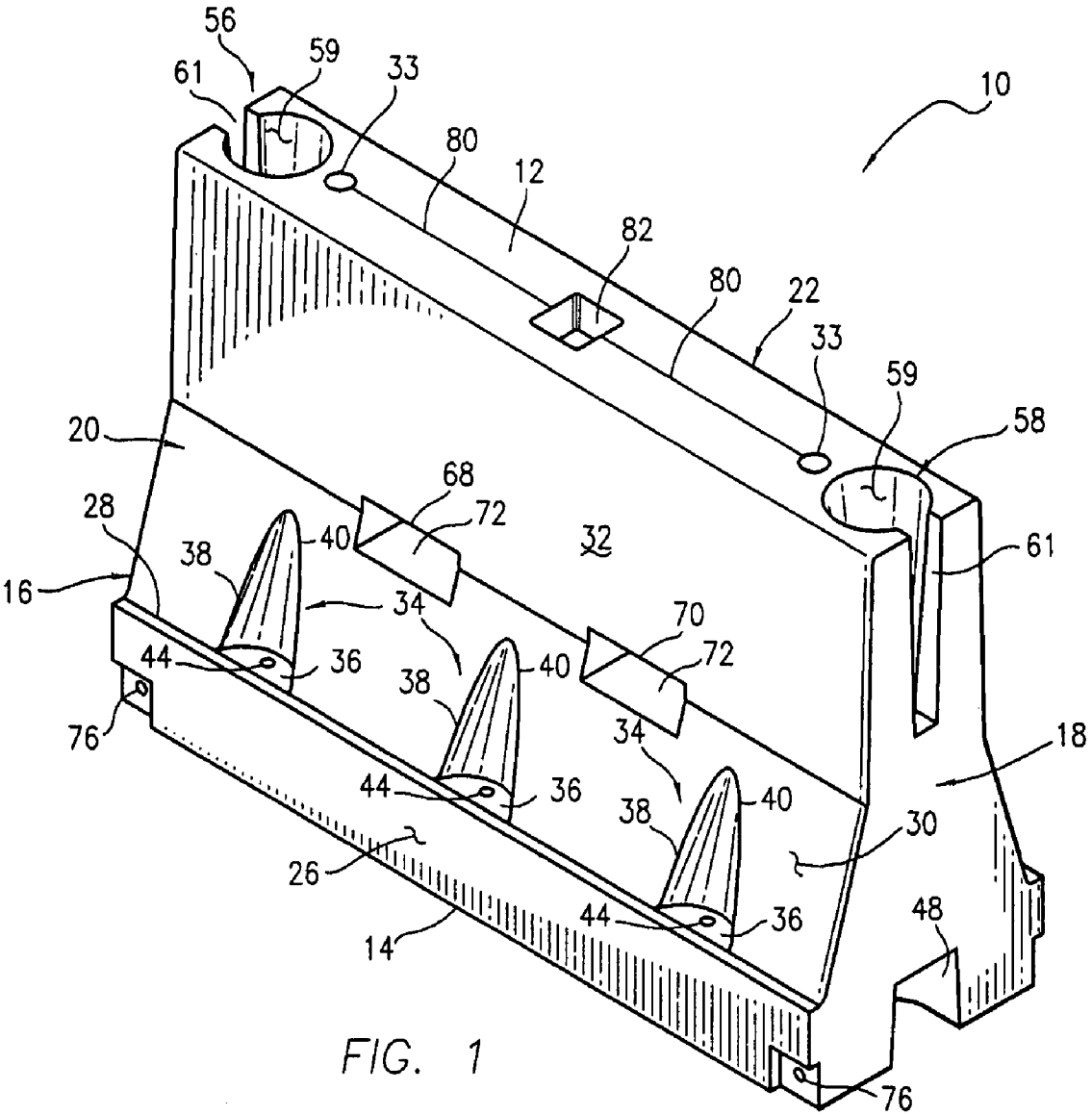
FIG. 1 is a perspective view of the barrier of this invention.

Referring initially to FIGS. 1-4, the barrier device 10 of this invention comprises a top wall. 12, a bottom wall 14, opposed end walls 16, 18, and, opposed side walls 20, 22 which are interconnected to collectively define a hollow interior 24. In the presently preferred embodiment, each of the walls 12-22 are formed of a semi-rigid plastic material chosen from the group consisting of low density polyethylene, high density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be added thereto, making such materials further resistant to the effects of weather. They also retain their mechanical and chemical properties at low ambient temperatures.

When using the barrier device 10 of this invention as a highway barrier, the hollow interior 24 is preferably filled with a "ballast" material such as water or other liquid, or a flowable solid material such as sand, concrete and the like. For this purpose, the walls 12-22 of barrier device 10 have a thickness in the range of about one-eighth inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1400 to 2200 lbs. Flowable solid material such as sand and the like increase the weight of barrier 10 further.

For ease of understanding and discussion of the principal aspects of this invention, the various structural elements of the barrier device 10 are described below in relation to their collective performance of a particular function of the barrier 10. These functions include the ability of the barrier 10 to better redirect and control the upper movement of a vehicle upon impact therewith, the ability to resist lateral separation of adjacent barriers 10 when they are joined end-to-end to form an essentially continuous wall, the ability to resist break up or disintegration of individual barriers in response to impact from a vehicle and the ability to float in water.

Control of Vehicle Movement

The control of vehicle movement upon impact with the barrier device 10 of this invention is achieved primarily by the material with which the barrier 10 is constructed, and the configuration of its side walls 20 and 22. Because both side walls 20, 22 are identical in configuration, only side wall 20 is described in detail herein, it being understood that the side wall 22 is formed with the identical structure and functions in the same manner.

The side wall 20 includes a substantially vertically extending curb reveal 26 which extends from the bottom wall 14 to a horizontally extending ledge or step 28 best shown in FIG. 1. Preferably, the curb reveal 26 has a vertical height of nine inches, measured from the bottom wall 14 upwardly, which is at least two inches greater than the curb reveals of other highway barrier devices, such as disclosed, for example, in my prior U.S. Pat. No. 5,123,773. The horizontal extent of the step 28 is preferably on the order of about 1½ inches measured in the direction from the outer edge of curb reveal 26 toward the hollow interior 24 of barrier device 10.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3-4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. As best seen in FIG. 1, the base 36 of each stabilizer 34 is coplanar with the step 28 and is supported by an internally located support 42 shown in phantom lines in FIG. 3. The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a throughbore 44 extends from the base 36 of one or more of the stabilizers 34, through the internal support 42 and out the bottom wall 14 of barrier 10. One or more of these throughbores 44 receive an anchoring device such as a stake 46, shown in phantom in FIG. 3, which can be driven into the ground or other surface upon which the barrier device 10 rests to secure it in an essentially permanent position thereon.

Enhanced control and redirection of the path of a vehicle impacting the barrier device 10 of this invention is achieved with the above-described structure as follows. The increased height of the curb reveal 26 of side wall 20, e.g., nine inches compared to seven inches or less for conventional barriers, is effective to engage and redirect the tires of a vehicle toward the lane in which the vehicle was traveling instead of in a direction toward the barrier 10 or the opposing lane of traffic. The curb reveal 26 is strengthened and reinforced by the presence of the horizontally extending ledge or step 28 and the stabilizers 34.

In the event the vehicle tires nevertheless extend above the curb reveal 26 upon impact, the intermediate and upper sections 30 and 32 are designed to resist further upward movement of the vehicle therealong. While the stabilizers 34 in intermediate section 30 function to add rigidity and stability to the overall barrier 10, the intermediate section 30 is nevertheless designed to at least partially collapse inwardly or buckle in response to the application of an impact force thereto. The extent of inward motion of buckling is controlled, at least to some extent, by the diameter of the fill holes 33 in the top wall 12. When the barrier interior 24 is filled with water, for example, the impact of a vehicle with a barrier side wall 20 or 22 causes such water to displace from the area of contact. Some of the water is forcefully discharged from the interior 24 through the fill holes 33, and the amount of such energy displacement is dependent on the diameter of the holes 33. The greater the diameter, the greater the amount of water displaced, and, hence, the more the barrier side wall 20 or 22 is permitted to buckle. It has been found that a fill hole 33 diameter of about 3-4 inches, noted above, is optimum wherein sufficient buckling of the side walls 20, 22 is permitted for the purposes described below without permanent damage to the barrier 10 upon impact with a vehicle. In the presently preferred embodiment, when the intermediate section 30 buckles inwardly, a pivot point is created about which the upper section 32 can move in a generally downward direction. Consequently, the tire and/or bumper of the vehicle is impacted by the upper section 32 of barrier device 10 and urged downwardly, back toward the pavement or ground along which the vehicle was traveling. This substantially prevents the vehicle from vaulting over the top of the barrier 10 and entering the opposing lane of traffic. Despite such movement of the intermediate and upper sections 30, 32 in response to impact, the material from which barrier device 10 is constructed allows such sections 30, 32 to return to their original shape after deformation.

Figure 2:
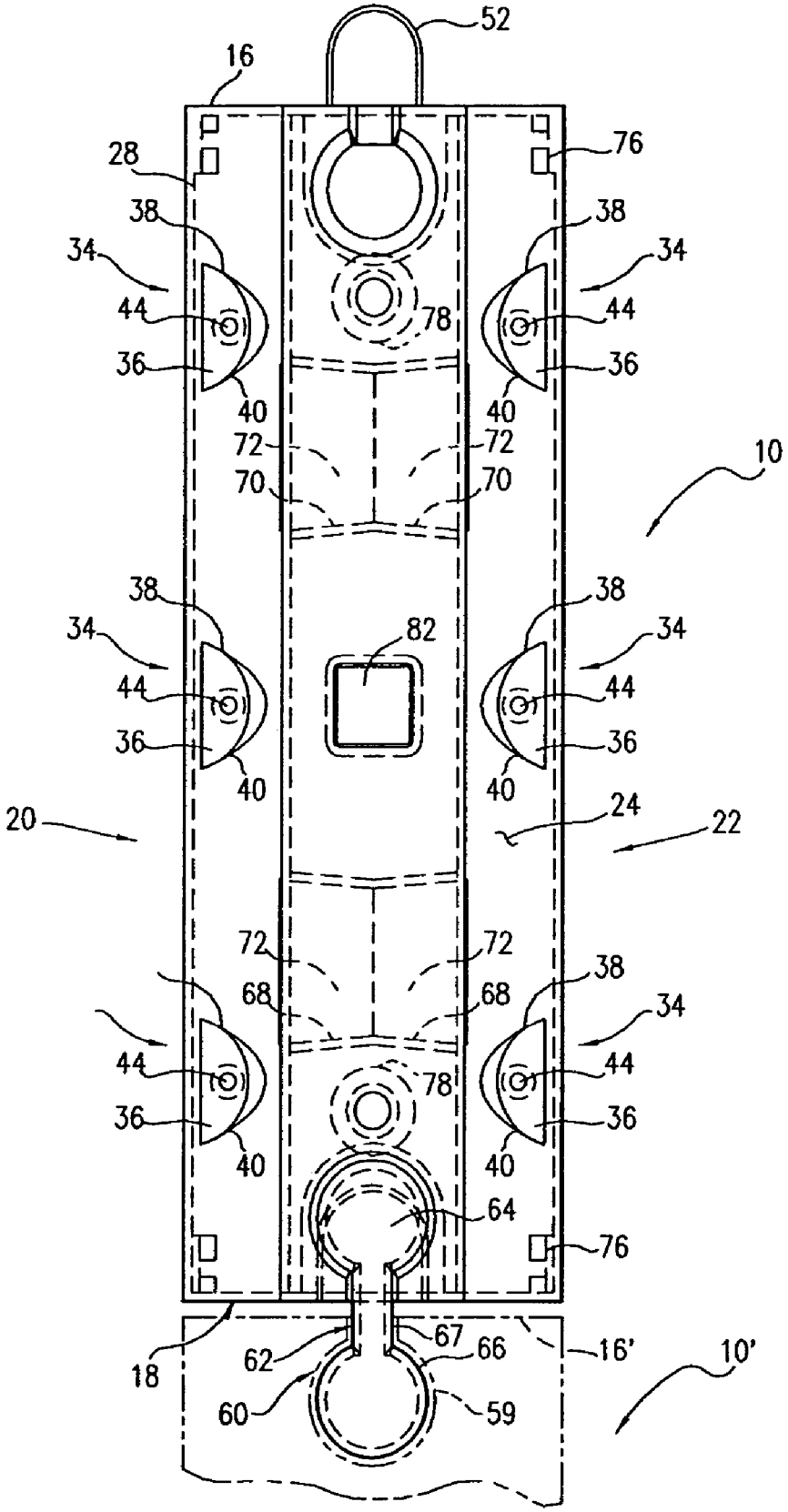
FIG. 2 is a plan view of the barrier depicted in FIG. 1, with a second barrier shown in phantom at one end.

In the presently preferred embodiment, a drain hole 76 is formed along each of the end walls 18 and 20 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

Resistance to Barrier Disengagement and Break Up

Figure 4:
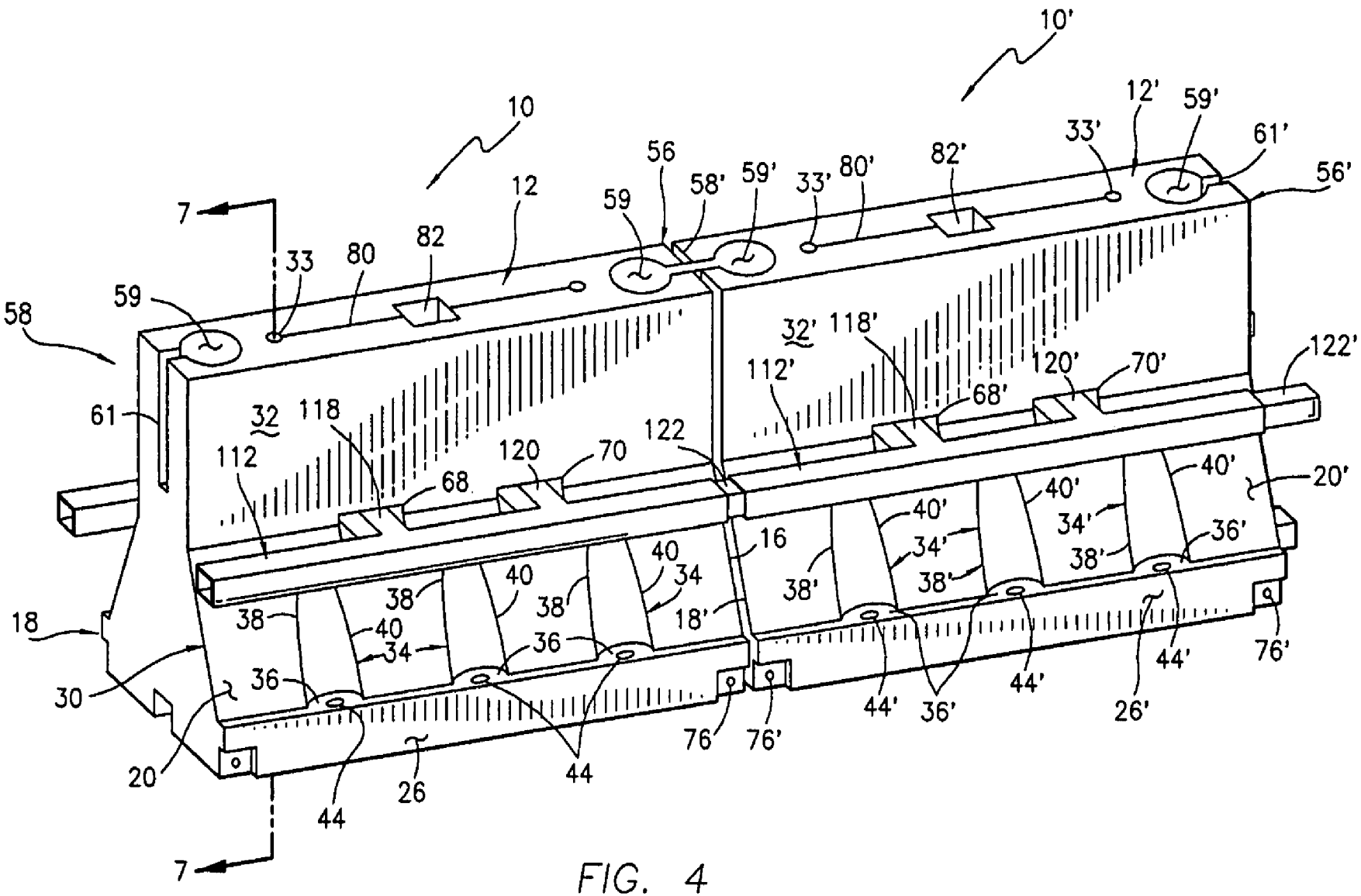
FIG. 4 is a perspective view of two barriers connected end-to-end with one embodiment of the external reinforcement structure of this invention.
Figure 9:
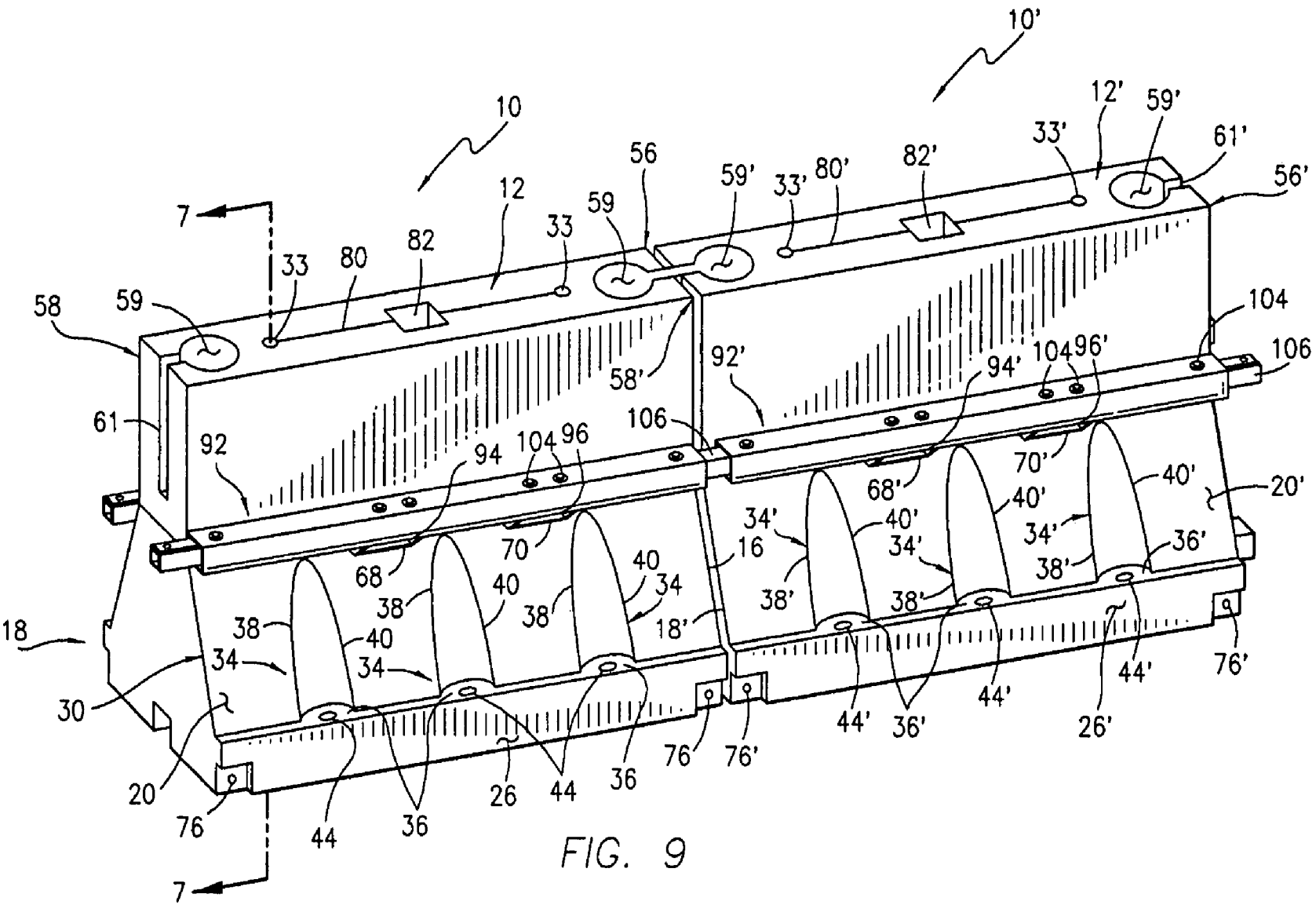
FIG. 9 is a view similar to FIG. 4, except depicting an alternative embodiment of the external reinforcement structure of this invention.

Another general aspect of the construction of the barrier device 10 of this invention involves a number of elements designed to resist disengagement of adjacent barrier devices 10 and 10' when they are arranged end-to-end to form an essentially continuous wall, and to resist the break up or disintegration of individual barrier devices 10 and 10' in response to impact by a vehicle. Two barrier devices 10 and 10' are depicted in FIGS. 4 and 9, which are identical in structure and function. The same reference numbers are therefore used to identify like structure, with the addition of a "'" to the numbers associated with barrier 10' on the right-hand side of FIGS. 4 and 9.

Each end wall 16 of barriers 10 is formed with an internally extending recess 48 near the bottom wall 14, which receives an outwardly protruding extension 52 formed on the end wall 18 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

When two barrier devices 10 and 10' are oriented end-to-end, with the end wall 16 of one barrier 10 abutting the end wall 18' of an adjacent barrier 10', the slots 56, 58 collectively form a barbell-shaped locking channel 60 shown in FIG. 4 and also depicted in phantom at the bottom of FIG. 2. This locking channel 60 receives a coupler 62 having cylindrical ends 64, 66 and a rectangular center section 67, which is removably insertable therein and extends substantially along the entire length of the locking channel 60. The cylindrical ends 64, 66 of coupler 62 pivot within the correspondingly shaped cylindrical portions 59, 59' of slots 56, 58', so that one barrier device 10 can be pivoted with respect to an adjacent barrier 10' to assist with alignment thereof, and to allow the barriers 10, 10' when placed end-to-end to follow curves along a particular highway or other location where they are placed.

Additionally, a pair of hollow channels 68 and 70 are located within the hollow interior 24 of barrier device 10 and extend between the side walls 20, 22. A portion of both channels 68, 70 is located in the intermediate section 30 of each side wall 20, 22, and extends partially into the upper sections 32 thereof. The two channels 68, 70 are positioned in the spaces between the three stabilizers 34 formed in the side walls 20, 22, and provide added internal support to the barrier 10 so that it retains its shape when filled with a ballast material. Each of the channels 68 and 70 define a pass-through hole or opening 72 adapted to receive the tines of a forklift truck to permit handling of the barriers 10.

In the presently preferred embodiment, a drain hole 76 is formed along each of the end walls 18 and 20 thereof near the bottom wall 14 to allow passage of water and the like from one side of the barrier device 10 to the other. Water or other flowable material is introduced into the hollow interior 24 of the barrier device 10 via the fill holes 33 formed in top wall 12. These fill holes 33 can also receive the post of a sign or the like (not shown) extendable into the barrier interior 24. As shown in FIG. 2, a post boot 78 is formed at the bottom wall 14 of barrier 10, in alignment with each fill hole 33, to receive and support the post of a sign inserted through the fill hole 33. Preferably, the top wall 12 is formed with an elongated channel 80 leading to each fill hole 33 to allow for the flow of rainwater into the hollow interior 24. The top wall 12 is also formed with an internally extending seat 82 which is adapted to mount an internal light fixture (not shown) for illuminating the barrier device 10 from the inside. The details of such lighting construction form no part of this invention and are thus not discussed herein.

With reference to FIGS. 9-13, one embodiment of the external reinforcement structure of this invention is shown.

Figures 10, 11, 12, 13:
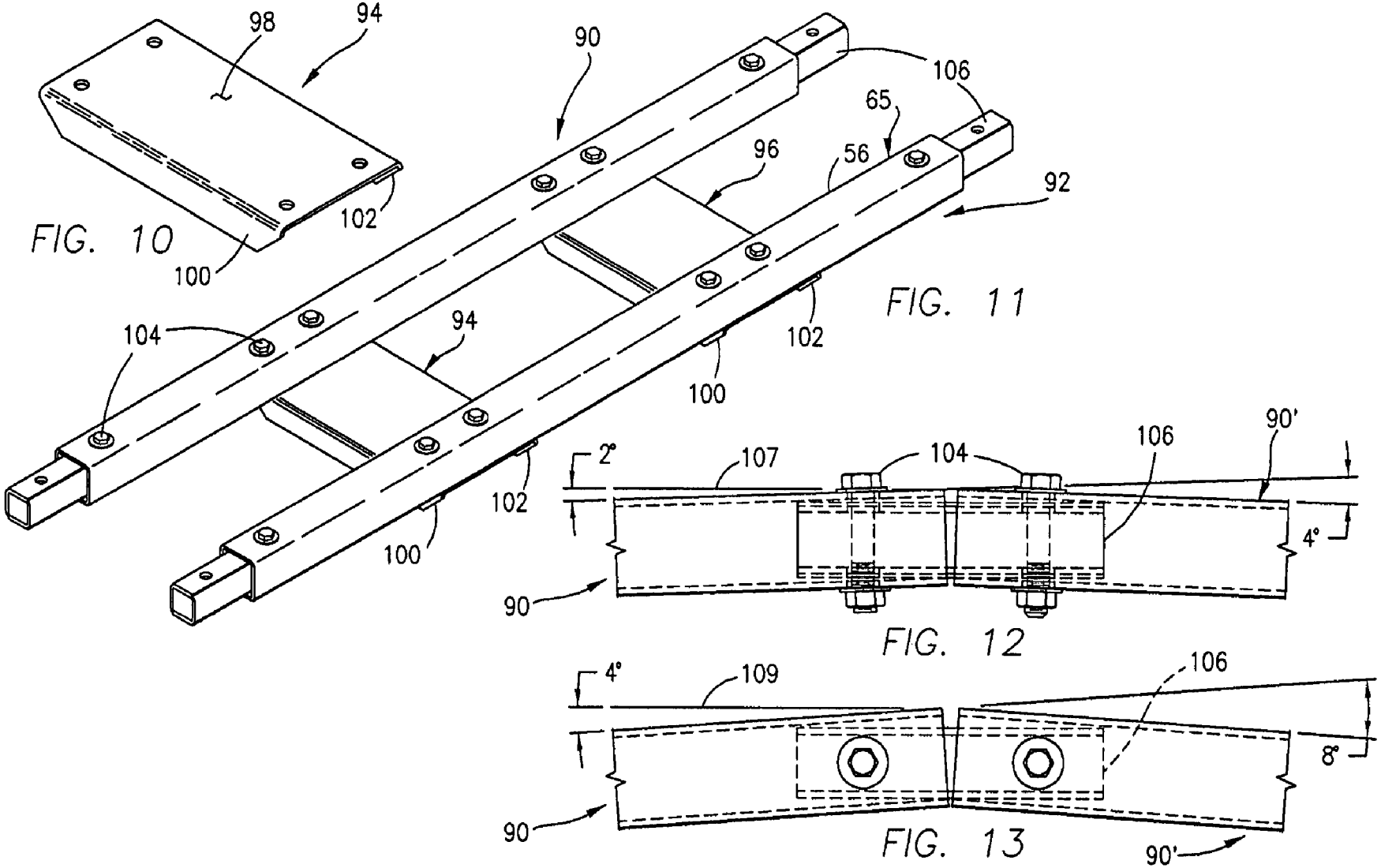
FIG. 10 is a perspective view of the mounting bracket employed in the embodiment of FIG. 9.
FIG. 11 is a perspective view of the assembled external reinforcement structure of the barrier device in FIG. 9.
FIG. 12 is a side elevational view of a portion of FIG. 11.
FIG. 13 is a plan view of a portion of FIG. 11.

Preferably, the reinforcing structure comprises a first beam 90 and a second beam 92 which are connected to one another by a pair of mounting brackets 94 and 96. As shown, the beams 90, 92 are preferably hollow box beams having a generally square cross section which can be formed of metal, rubber, composite material or the like. The mounting brackets 94 and 96 each include a plate 98 whose opposite side edges are mounted to or integrally formed with vertically upstanding legs 100 and 102. The mounting bracket 94 is inserted within the opening 72 formed by channel 68, and the mounting bracket 96 is inserted within the opening 72 formed by channel 70 such that opposite ends of each mounting bracket 94, 96 protrude from one of the side walls 20 and 22. As best seen in FIGS. 9 and 11, with the mounting brackets 94, 96 in this position, the box beams 90 and 92 are connected to respective ends of the brackets 94, 96 such as by bolts 104. Because the mounting brackets 94, 96 include the upstanding legs 100 and 102, the channels 72 are not completely obstructed upon assembly of the beams 90, 92 and the tines of a fork lift can still be inserted within the openings 72 with the mounting brackets 94, 96 and beams 90, 92 assembled to the barrier 10 or 10'.

In order to interconnect the beams 90, 92 of one barrier device 10 to those of an adjacent barrier device 10', a connector bar 106 is inserted within one open end of each beam 90, 92 and retained in place by bolts 104. The connector bars 106 have a cross sectional area which is sufficiently less than that of the ends of beams 90, 92 to permit pivotal motion of the beams 90, 92 of barrier 10 relative to the beams 90', 92' of barrier 10' as depicted in FIGS. 12 and 13. The view in FIG. 12 is representative of vertically upward and downward relative movement of two beams 90 and 90' from barrier devices 10 and 10', respectively, which in the orientation as shown, amounts to about 2° movement of each relative to a horizontal plane 107 and 4° of movement with respect to one another. FIG. 13 illustrates relative side-to-side horizontal movement of the beams 90 and 90' in an amount of about 4° measured from the horizontal plane 109 and about 8° with respect to one another. This feature enables one barrier device 10 to pivot relative to an adjacent barrier device 10' to accommodate at least gradual curves and height differentials when forming a barrier wall, and to facilitate assembly of the barriers 10, 10'.

Figures 5, 6, 7, 8:
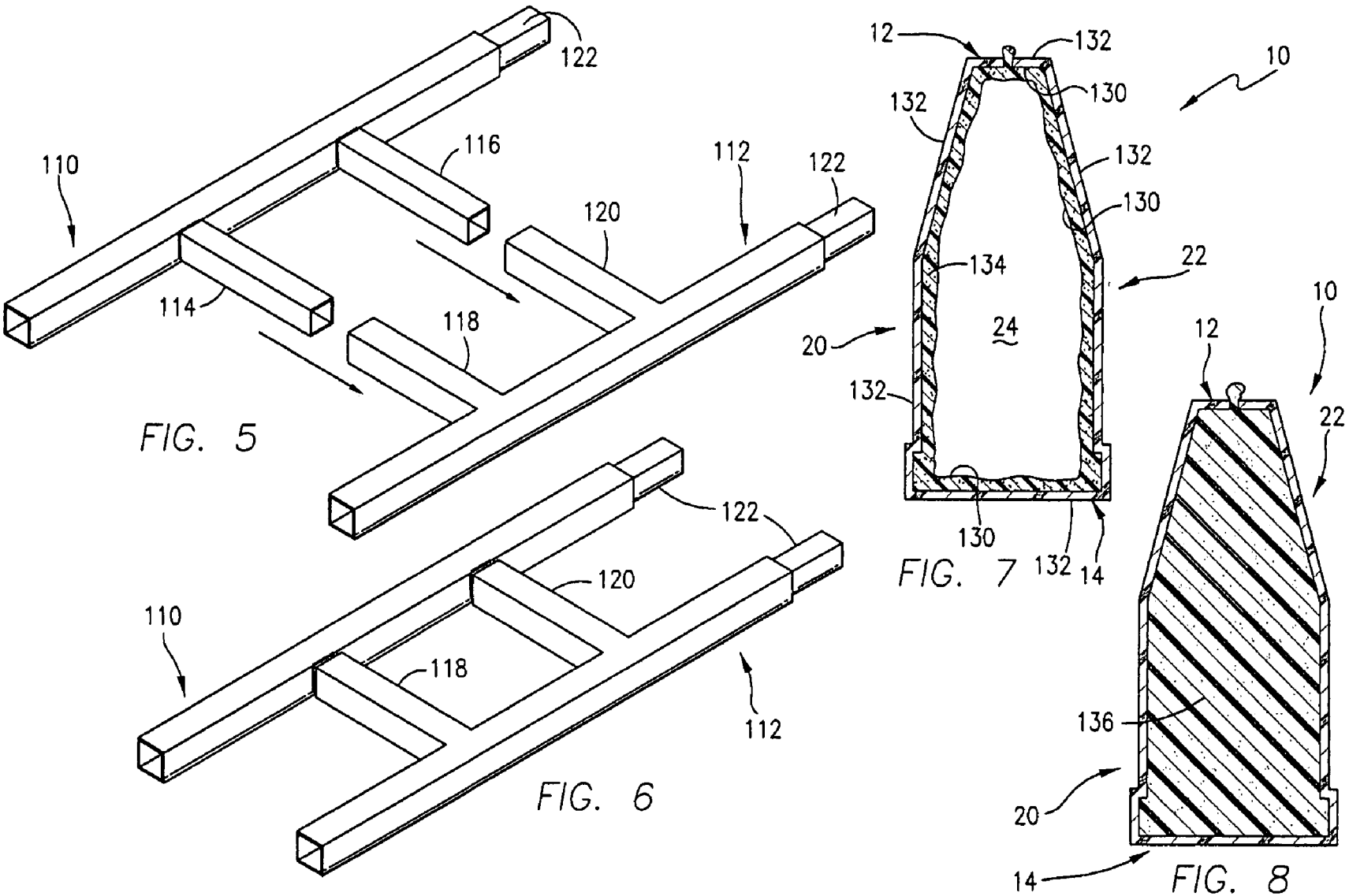
FIG. 5 is an exploded, perspective view of the mounting bracket employed with the barriers claim 4.
FIG. 6 is a perspective view of the assembled reinforcing structure of FIG. 5.
FIG. 7 is a cross sectional view of the barrier shown in FIG. 1 depicting the foam layer along the walls within the barrier interior.
FIG. 8 is a view similar to FIG. 7 except with the hollow interior of the barrier device completely filled with foam.

Referring now to FIGS. 4-6, an alternative embodiment of the external reinforcement structure of this invention is shown. Box beams 110 and 112 are provided, which, like the beams 90 and 92 noted above, are preferably square in cross section and formed of metal, rubber, composite material or the like. The box beam 110 has a pair of spaced arms 114 and 116 which extend perpendicularly therefrom, and box beam 112 is formed with a pair of perpendicularly extending sleeves 118 and 120. When the beams 110 and 112 are in position along the side wall 20 and 22, respectively, the arms 114, 116 of beam 110 register and telescope within the sleeves 118, 120 to hold them together. See FIG. 6.

Instead of a connector bar 106 used in the embodiment of FIGS. 4-8, the beams 90, 92 of one barrier 10 are connected to respective beams 90', 92' of an adjacent barrier 10' with reduced area extensions 122 formed at one end of each beam 90, 92. As best seen in FIG. 4, the extensions 122 at the end of beams 90, 92 of barrier 10 are inserted within the respective aligning ends of the beams 90', 92' of barrier 10' to connect them together. Such connection can be a friction fit between the extensions 122 and beams 90', 92' or bolts (not shown) can be employed.

Figures 14, 14A, 15C:
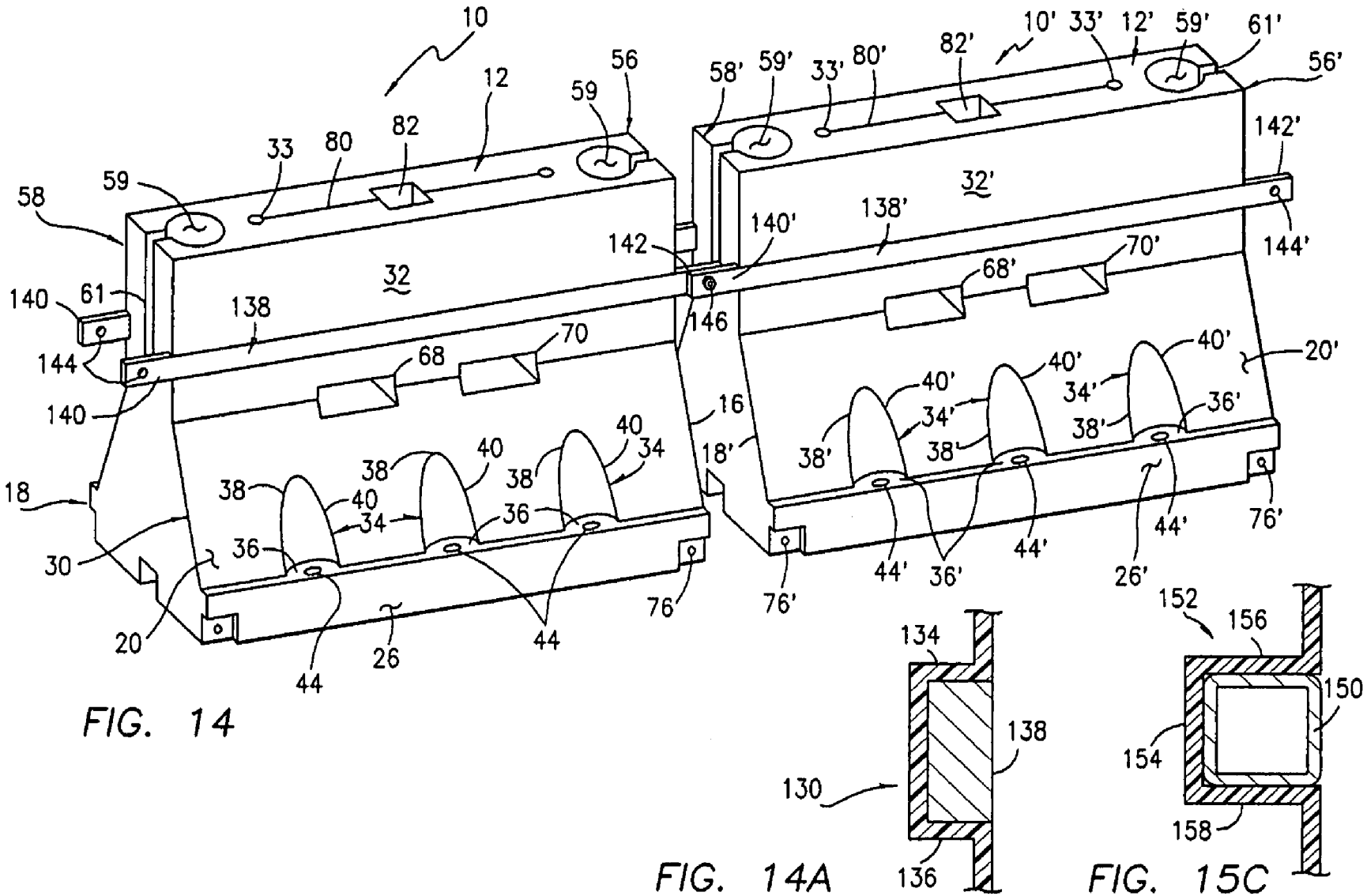
FIG. 14 is a view similar to FIG. 4, except illustrating a still further embodiment of the barrier of this invention.
FIG. 14A is a cross sectional view of a portion of a side wall and slat shown in FIG. 14.
FIG. 15C is a cross sectional view of a portion of side wall and box beam shown in FIG. 15.
Figures 15, 15A, 15B:
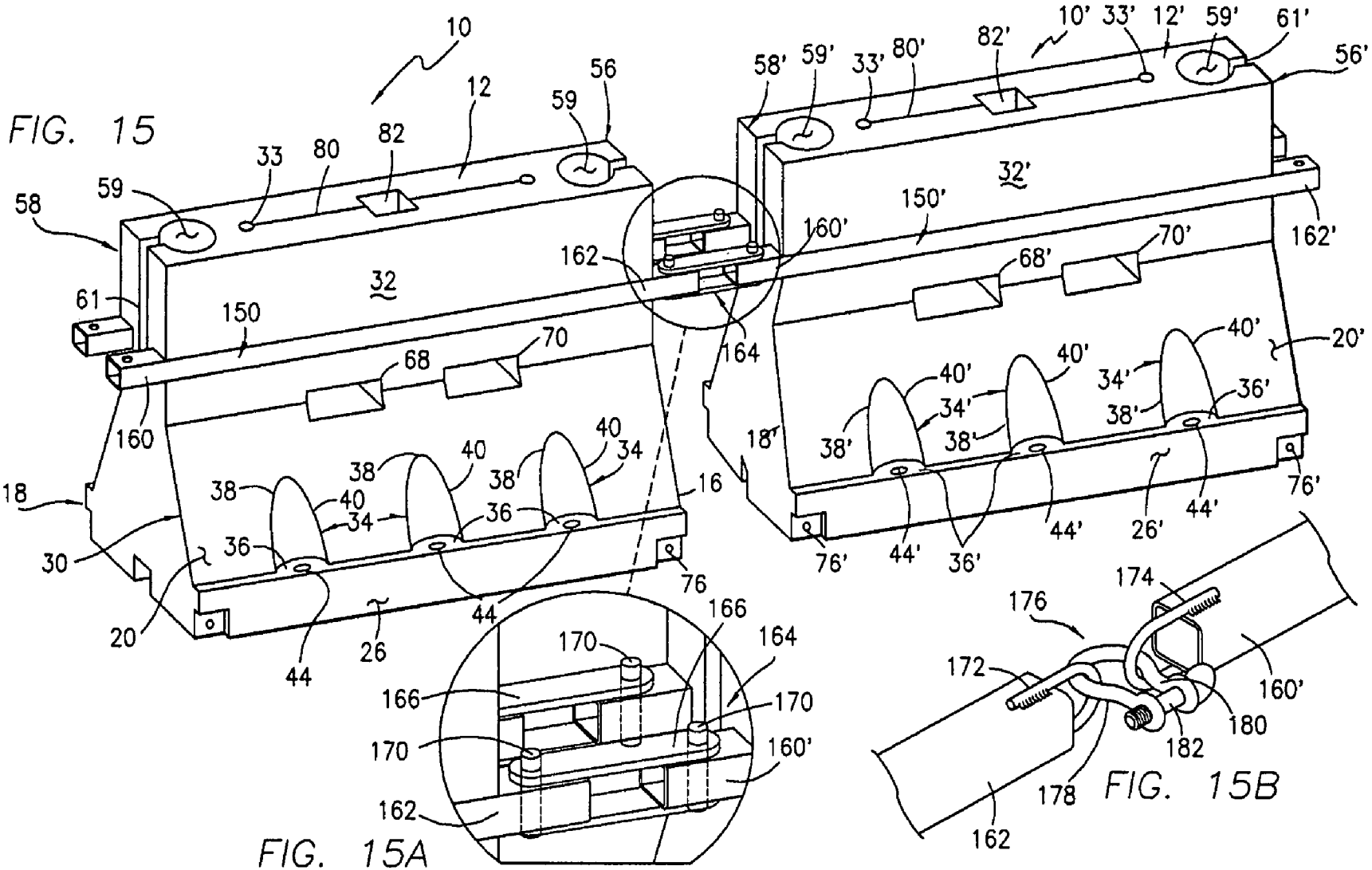
FIG. 15 is a view similar to FIG. 14, except depicting another barrier according to this invention.
FIG. 15A is an enlarged view of the encircled portion of FIG. 15.
FIG. 15B is an alternative embodiment of the encircled portion of FIG. 15 showing another connector structure for securing adjacent barriers to one another.

Still further embodiments of the external reinforcement structure according to this invention are shown in FIGS. 14 to 15C. These embodiments differ from those described above because instead of securing beams to mounting devices carried by channels 68 and 70, the barriers 10, 10' are modified to incorporate seats in each side wall which mount a beam or slat. The protruding ends of such beams or slats from one barrier are connected to those of an adjacent barrier to form a barrier wall.

Referring initially to FIGS. 14 and 14A, each side wall 20 and 22 of the barrier 10 is formed with a seat 130 which extends longitudinally between the opposed end walls 16 and 18. Each seat 130 extends from the outer surface of a respective side wall 20, 22 toward the hollow interior 24 of the barrier device 10, forming an inner wall 132, a top wall 134 and a bottom wall 136. See FIG. 14A. These walls 132, 134 and 136 of the seat 130 receive and tightly frictionally engage a generally rectangular-shaped slat 138, which is formed of metal or other rigid material and has a solid cross section. Preferably, the depth of the seat 130 is approximately equal to the thickness of the slat 138 so that the slat 138 is substantially flush with the outer surface of the side walls 20, 22 when mounted in place.

As seen in FIG. 14, opposite ends 140 and 142 of each slat 138, and opposite end 140', 142' of slat 138', protrude beyond the end walls 16, 18 of the barrier devices 10, 10' respectively, and are formed with a through bore 144. In order to connect adjacent barrier devices 10 and 10' together, the through bore 144 in the protruding end 142 of slat 138 of barrier device 10 is aligned with the through bore 144 in the protruding end 140' of the slat 138' in the barrier device 10'. A bolt 146 is then inserted through the aligning through bores 244 and secured by a nut. Alternatively, a rod (not shown) can be inserted through the aligning through bores 144 and secured with a cotter pin.

Referring now to FIGS. 15-15C, essentially the same concept described above in connection with FIGS. 14-14B is employed except using box beams 150 instead of slats 138. The side walls 20 and 22 of barrier 10 are each formed with a seat 152 having a cross section defined by an inner wall 154, spaced from the outer surface of the side walls 20, 22, a top wall 156 and a bottom wall 158. Each seat 152 frictionally engages a box beam 150, which are essentially the same construction as the box beams 92 and 112 described above. Preferably, the depth of the seat 152 and the width of the box beam 150 are approximately equal so that the box beam 150 is flush with the outer surface of each side wall 20, 22.

Two different structures for connecting the box beams 150 and 150' of adjacent barriers 10 and 10' are depicted in FIGS. 15A and 15B, although it is contemplated that other connectors could be employed. As seen in FIG. 15, opposite ends 160 and 162 of each box beam 150 protrude beyond respective end walls 16 and 18 of the barrier device 10, and the ends 160', 162' of box beam 150' protrude beyond the end walls 16', 18' of barrier device 10'. In the embodiment of FIG. 15A, the protruding end 162 of box beam 150 mounted to the barrier 10 is connected to the protruding end 160' of the box beam 150' of the barrier 10' by a bracket 164. The bracket 164 comprises a top plate 166 which spans between and rests atop the protruding ends 162 and 160' of the box beams 150, 150', and a bottom plate 168 extending along the bottom surface of the protruding ends 162, 160'. A pin, bolt of other connector 170 is inserted through one end of both plates 166, 168 and the box beam 150 of barrier 10, as well as the opposite end of both plates 166, 168 and the box beam 150' of the barrier 10'. Preferably, a pin is employed for the connectors 170 to permit at least limited pivotal motion of the barriers 10 and 10' relative to one another, i.e., each of the plates 166 and 168 can rotate about the pin connector 170, thus allowing the barriers 10, 10' to pivot.

An alternative embodiment of the connecting device between the beams 150 and 150' of adjacent barriers 10, 10' is shown in FIG. 15B. This connecting device, or "hitch connector," includes a first U-shaped member 172 mounted to the protruding end 162 of barrier 10, a second U-shaped member 174 mounted to the protruding end 160' of barrier 10' and a coupler 176 extending between the members 172, 174. Preferably, the members 172, 174 are welded or other permanently mounted to the beams 150, 150'. The coupler 176 is formed in the general shape of a C-clamp with arms 178 and 180 which engage respective members 172, 174. The free ends of arms 178, 180 and are joined by a bolt 182 to secure the coupler 176 in place. Each of the beams 150, 150' are permitted to pivot at their connection to the coupler 176, which, in turn, allows the barriers 10 and 10' pivot relative to one another.

Figure 16:
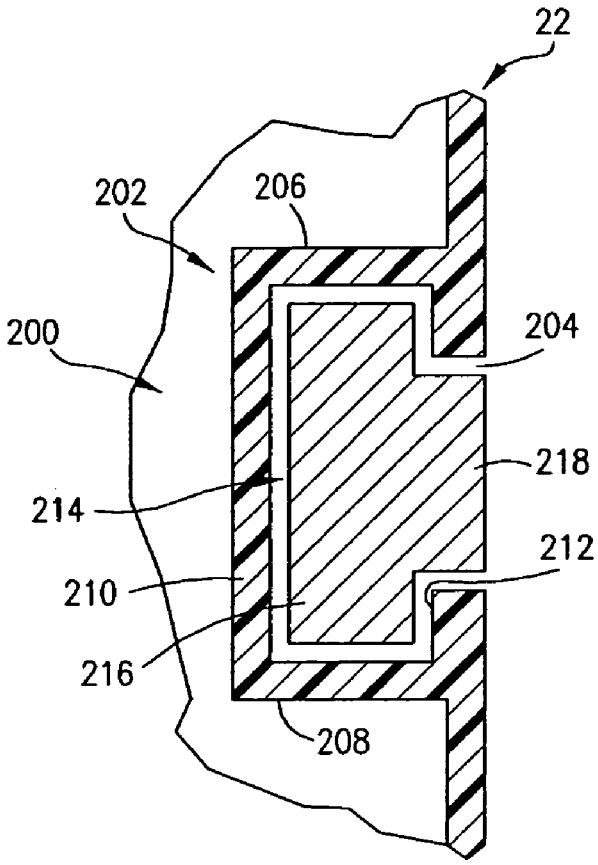
FIG. 16 is a view similar to FIGS. 14A and 15C except depicting a slat or beam which is captured within a correspondingly shaped seat formed in the side wall of the barrier device.
Figure 17:
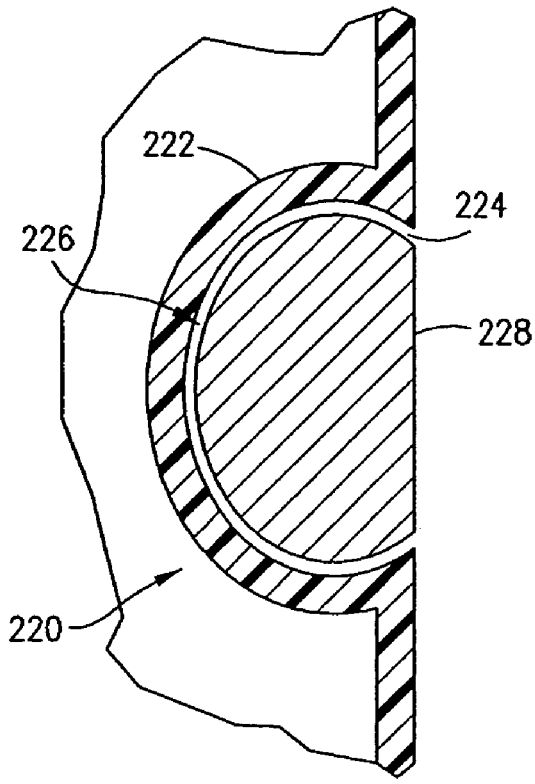
FIG. 17 is a view similar to FIG. 16 depicting an alternative slat or beam shape.

Referring now to FIGS. 16 and 17, still further embodiments of the slats or beams shown in FIGS. 14 and 15 are illustrated. Both the slat 138 of FIG. 14 and the box beam 150 of FIG. 15 are frictionally retained within the side walls 20, 22 of a barrier 10. In order to provide a more secure connection, FIGS. 16 and 17 depict arrangements in which a beam or slat is mechanically retained within a seat formed in the side walls 20, 22. In the embodiment of FIG. 16, each side wall 20 and 22 of the barrier 10 is formed with a generally T-shaped seat 200 which extends longitudinally between the opposed end walls 16 and 18. Each seat 200 has an inner wall 202 located within the hollow interior 24 of the barrier 10, and an outer opening 204 substantially flush with the side wall 20 or 22. The inner wall 202 is defined by a top portion 206, bottom portion 208 and side portion 210, with a shoulder 212 being formed at the outer opening 204. A correspondingly shaped beam 214, having a head section 216 connected to a stem section 218, is inserted into the seat 200 from one end wall 16 to the other end wall 18, or vice versa. Preferably, the stem section 218 of the beam 214 extends into the outer opening of the seat 200 and is substantially flush with the outer surface of the side wall 20 or 22. As seen in FIG. 16, the beam 214 is mechanically retained within the seat 200 by engagement of the head section 216 of the beam 214 with the shoulder 212 of the seat 200.

Another embodiment of this invention wherein a beam or slat is mechanically retained within a seat formed in the side walls 20 and 22 is shown in FIG. 17. In this embodiment, a C-shaped seat 220 having an inner wall 222 and an outer opening 224 is formed in each side wall 20, 22. The seat 220 receives a correspondingly shaped beam or slat 226 which is inserted therein from one of the end walls 16 or 18. The slat 226 has a flattened outer surface 228 which is substantially flush with the outer surface of the side wall 20 or 22. Because the outer opening 224 of seat 220 is narrower than the slat 226, the slat 226 is mechanically retained within the seat 220.

It is contemplated that shapes of seats and beams or slats may be employed other than those shown in FIGS. 16 and 17 to achieve a "mechanical" retention of the beams within the side walls 20, 22. As such, the key aspect of both FIGS. 16 and 17 is to provide a seat, such as seats 200 and 220, each having with a height dimension which is greater than the height dimension of their outer opening. The term "height dimension" as used herein refers to a distance measured in the vertical direction with the seats 200 and 220 in the orientation as shown in FIGS. 16 and 17. As such, the height dimension of the inner wall 202 of seat 200 is the vertical distance between the top and bottom portions 206, 208, and the height dimension of the inner wall 222 of seat 220 is considered to be the largest distance which can be measured in the vertical direction. Similarly, the "height dimension" of the outer openings 204 and 224 of the seats 200 and 220, respectively, is the largest distance which can be measured in the vertical direction. Regardless of the exact shape of the seat in the side wall, and the correspondingly shaped slat or beam, if the height dimension of the inner wall is greater than the height dimension of the outer opening as herein defined, the slats or beams are mechanically retained within the seats.

Figure 18:
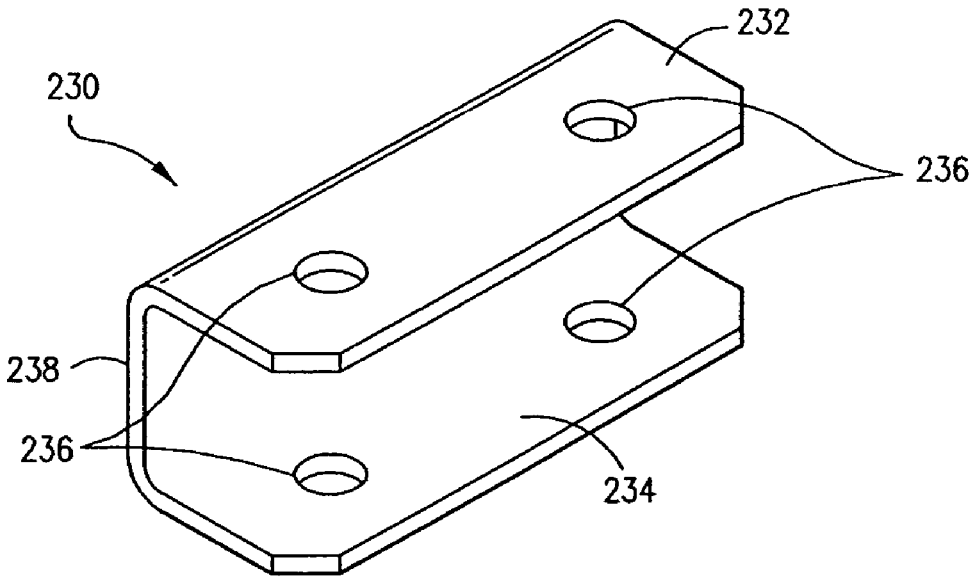
FIG. 18 is an enlarged view of a C-clamp for connecting the ends of the beams or slats or adjacent barriers.
Figure 19:
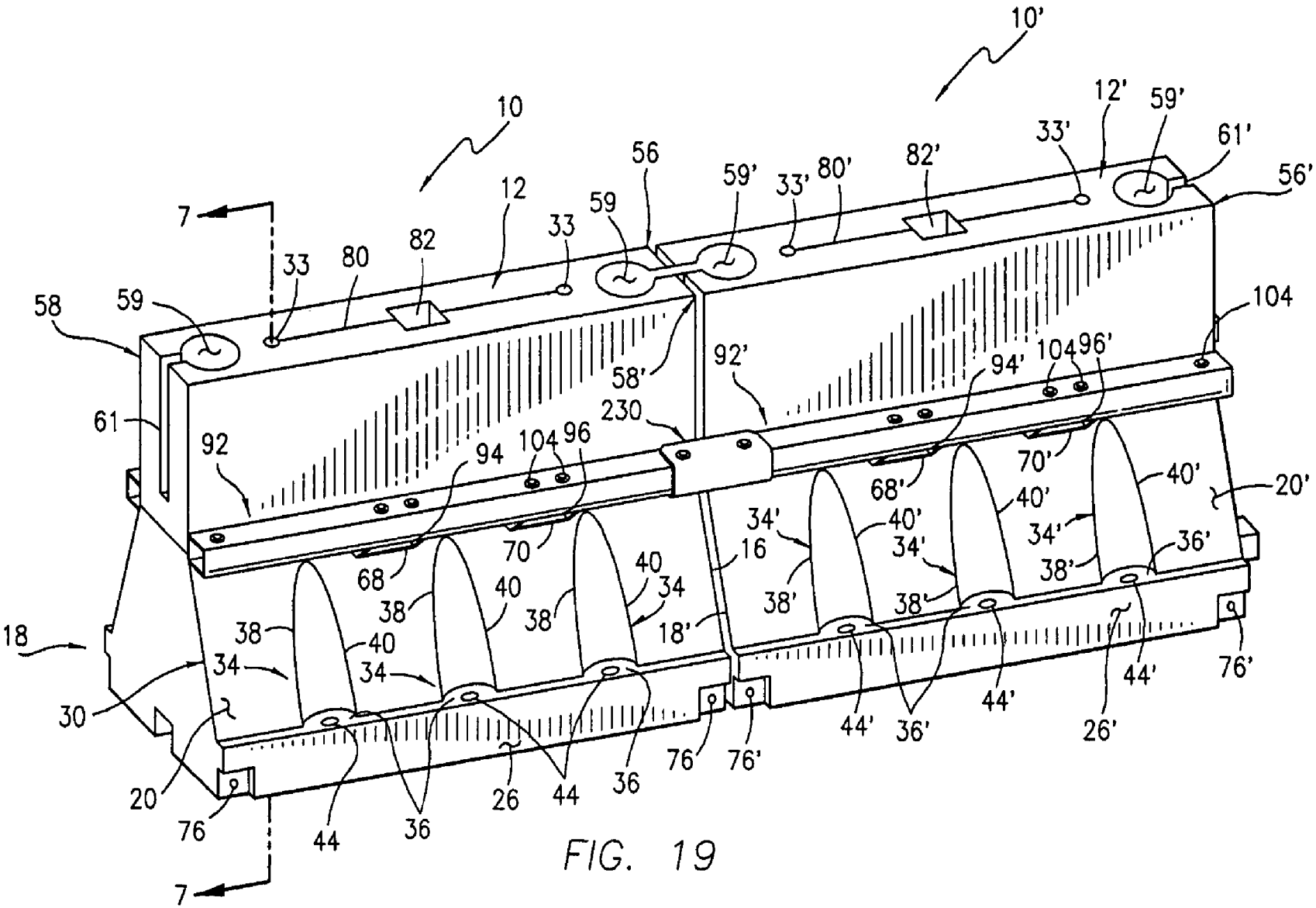
FIG. 19 is a side view similar to FIG. 9 except illustrating the C-clamp of FIG. 18 mounted to the ends of the beams of adjacent barriers.
Figure 20:
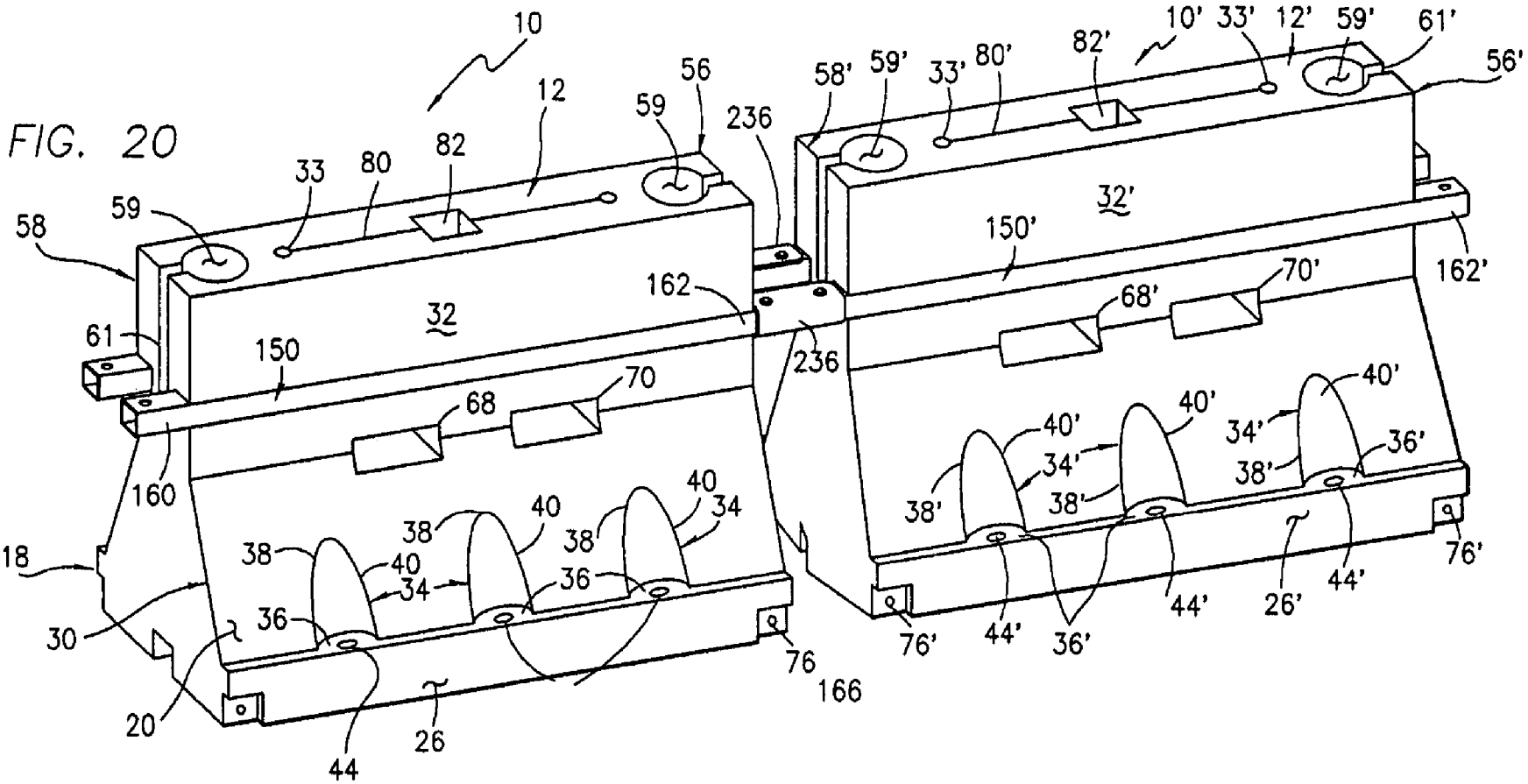
FIG. 20 is a side view similar to FIG. 14 except showing the C-clamp of FIG. 18 mounted to the ends of the slats of adjacent barriers.

Referring now to FIGS. 18-20, a still further embodiment of a mounting device for connecting the protruding ends of the beams or slats shown in previous embodiments is illustrated. A C-shaped clamp 230 is provided having top and bottom legs 232 and 234, formed with aligning bores 236, which are integrally formed or connected to a side leg 238. It has been discovered that the beam or slat connectors shown in FIGS. 14, 15A and 15B are subject to wear in the field, and the connector arrangement shown in FIGS. 12 and 13 can result in problems of wedging of the connector bars 106 within the box beams 90 or 92 of an adjacent barrier device 10. These problems are eliminated with the C-shaped clamp 230 herein. The C-shaped clamp 230 extends between the ends of box beams 92 and 92' of adjacent barrier devices 10, 10' where it is bolted in place, as shown in FIG. 19, or extends between the ends of the slats 150, 150' of adjacent barrier devices 10, 10' where it is similarly bolted in place. See FIG. 20. In each case, the side leg 238 of the clamp 230 faces outwardly, in the direction of vehicular or pedestrian traffic. The clamp 230 is formed of rugged, high strength steel or the like which overcomes the potential wear problems with the connectors of FIGS. 14, 15A and 15B. Additionally, because there is a space between the top and bottom legs 232, 234 opposite the side leg 238 of the C-shaped clamp 230, no wedging or binding occurs between the clamp 230 and protruding ends of beams 92, 92' or 150, 150' in the event the barriers 10, 10' are moved relative to one another as a result of a vehicle impact or the like. Consequently, unlike the arrangement of FIGS. 12 and 13, adjacent barriers 10 and 10' may be readily separated from one another when it is time to disassemble a barrier wall.

Figure 3:
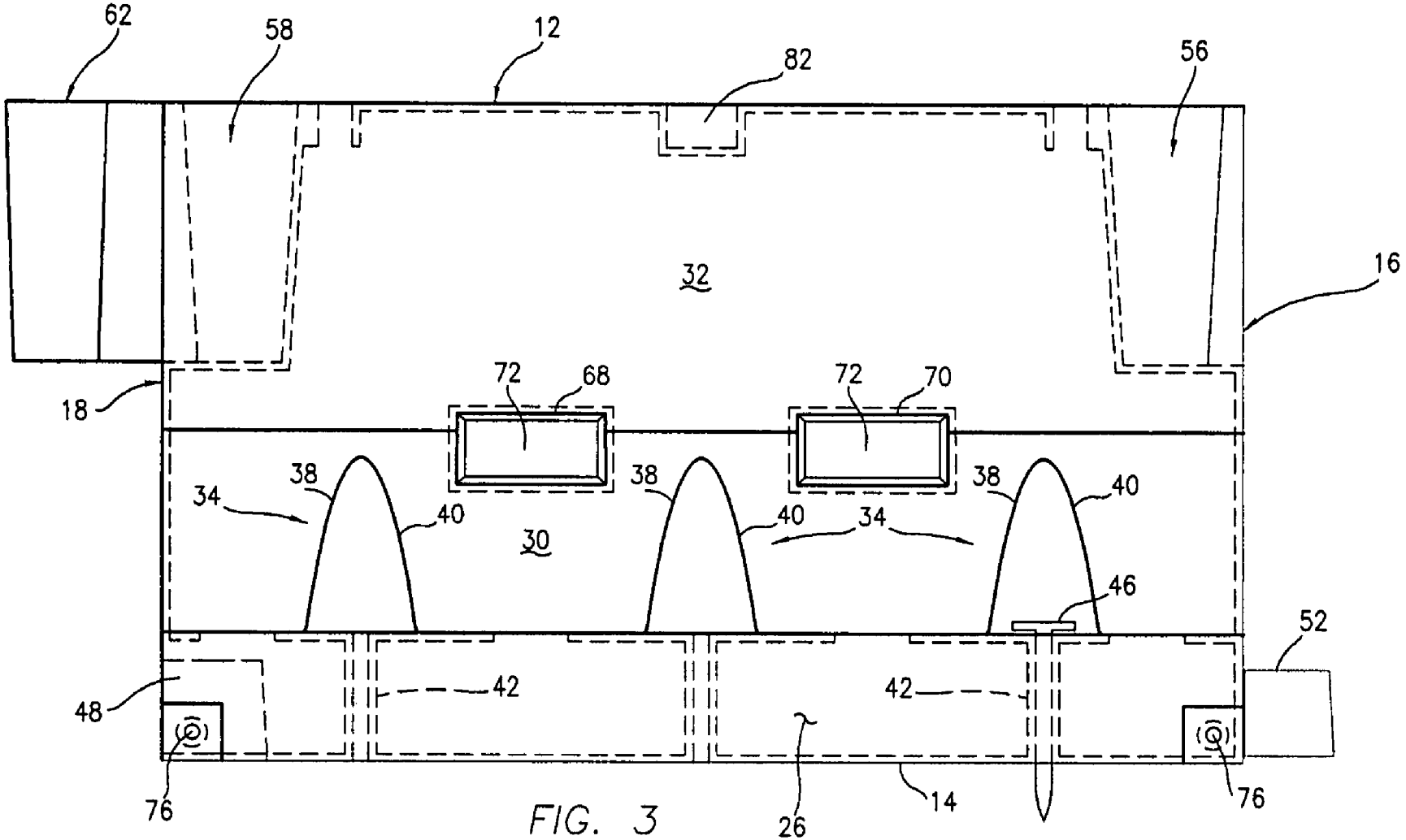
FIG. 3 is a side view of the barrier of FIG. 1.
Figure 21:
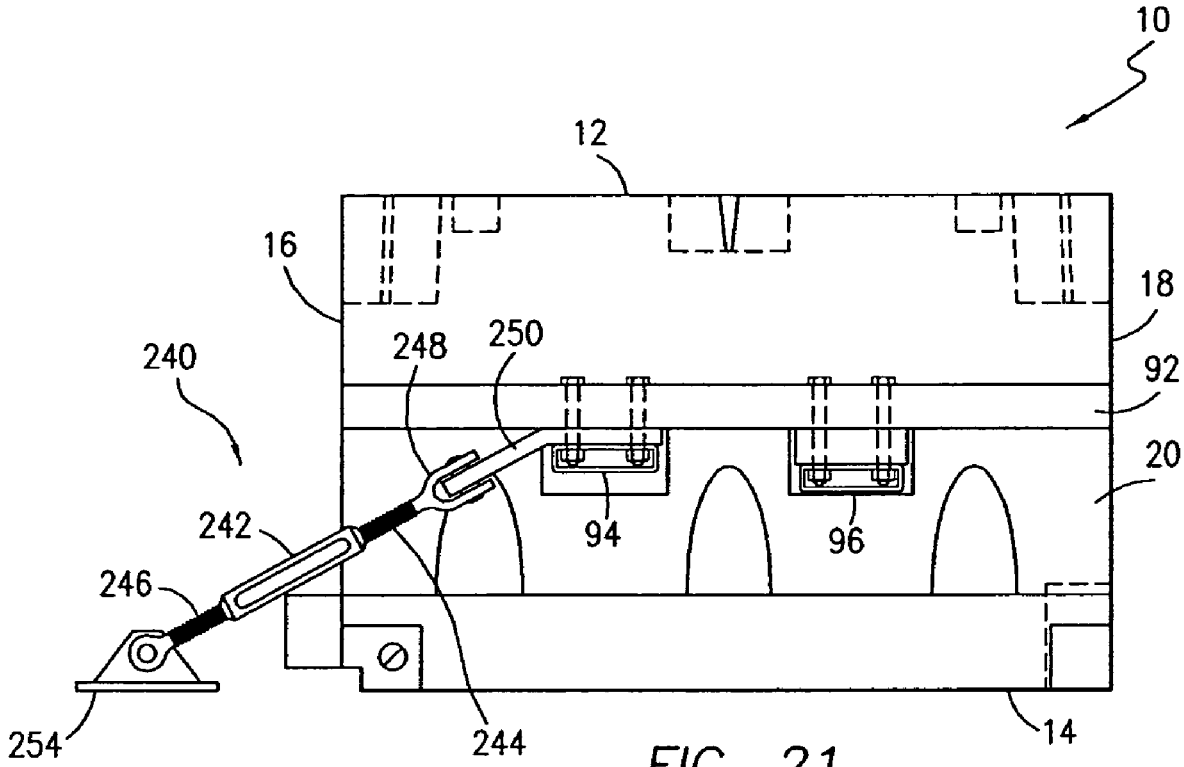
FIG. 21 is a side view of the barrier device depicted in FIG. 9 depicting a ground anchor connected to the mounting bracket which support the beams.
Figure 22:
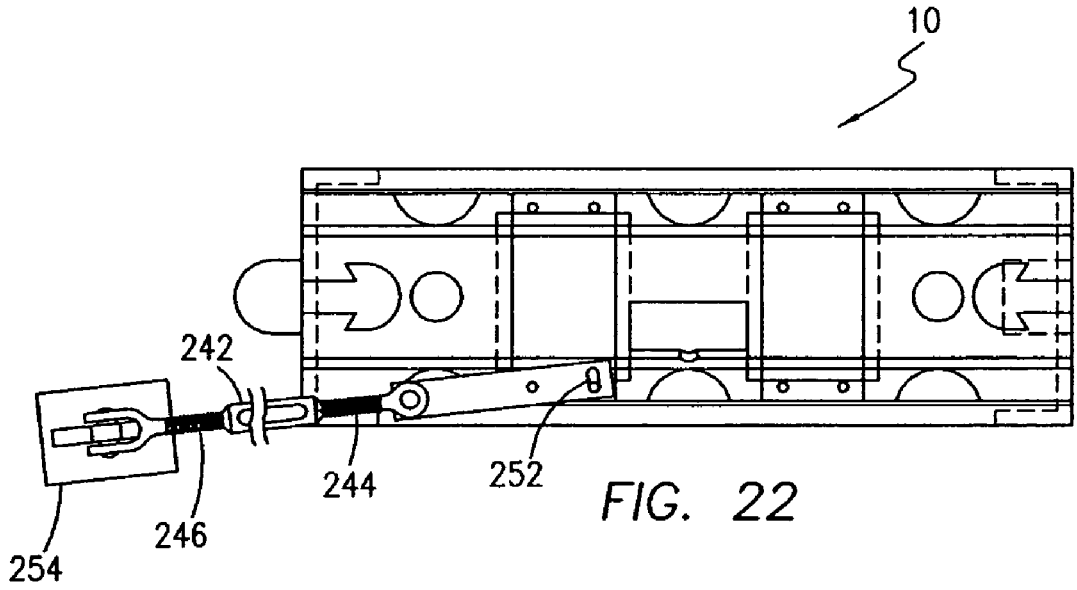
FIG. 22 is a plan view of FIG. 21.

As shown in FIG. 3, the stability of the barrier devices 10 on a particular surface may be enhanced by driving a stake 46 into one or more through bores 44 formed in an internal support 42 of the barrier device 10. Referring now to FIGS. 21-24, additional anchoring devices are shown. In the embodiment of FIGS. 21 and 22, a ground anchor 240 is depicted for use with beams 90 and 92 carried by a mounting bracket 94 as shown in FIGS. 9-11 and discussed in detail above. The ground anchor 240 comprises a turnbuckle 242 connected at one end to the threaded shaft of an upper arm 244 and at the opposite end to the threaded shaft of a lower arm 246. The upper arm 244 has a yoke 248 which is pivotally connected to tubular connector 250. The tubular connector 250 is sandwiched between box beam 92 and the mounting bracket 94, and connected thereto by bolts. Preferably, at least one of the bores formed in the tubular connector 250 to receive the bolts is formed with a slot 252 for added adjustment of the position of the ground anchor 240. See FIG. 22. The lower arm 246 is pivotally connected to a base 254 which may be secured to the ground, a roadway or the like by stakes (not shown) to enhance the stability of the barrier devices 10 and resist their disengagement from one another in the event of an impact with a vehicle or the like. Conventionally, the threads on the shafts of the upper and lower arms 244 and 246 are opposite to one another so that the turnbuckle 242 may be rotated in one direction to extend both arms 244, 246 and in the opposite direction to retract them.

Figure 23:
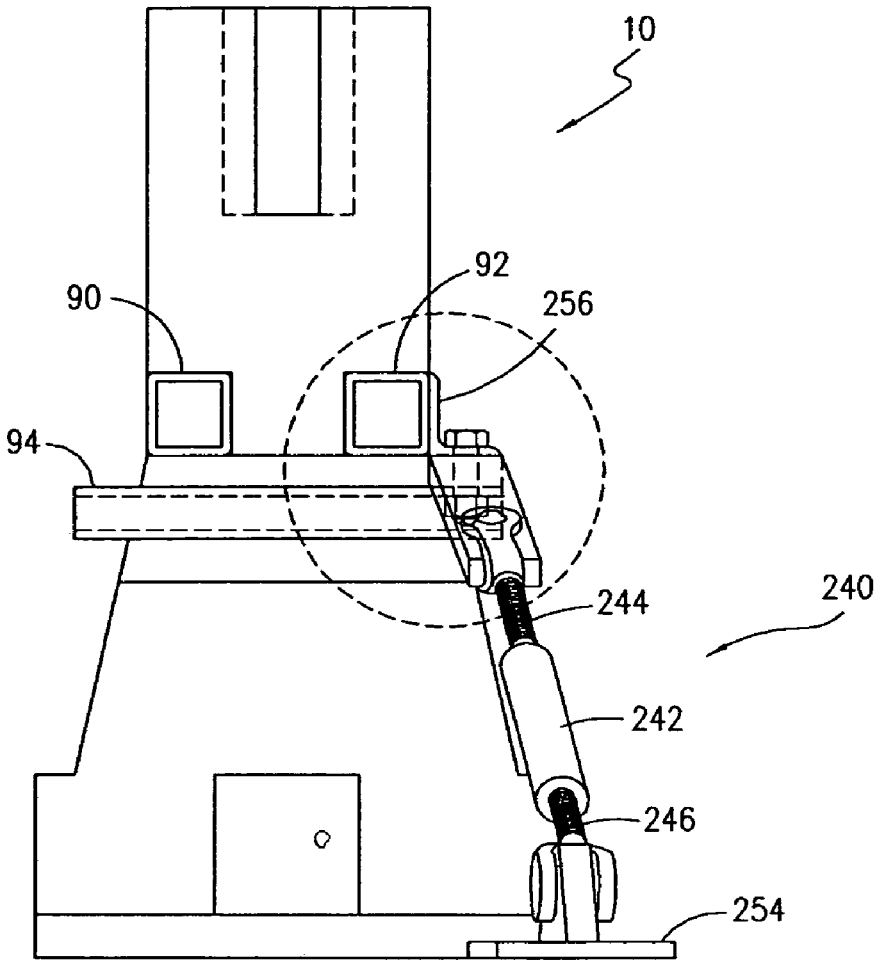
FIG. 23 is an end view of a barrier device similar to that shown in FIG. 14 except including a mounting bracket extending through the fork lift holes of the barrier and a ground anchor of the type depicted in FIG. 21.
Figure 24:
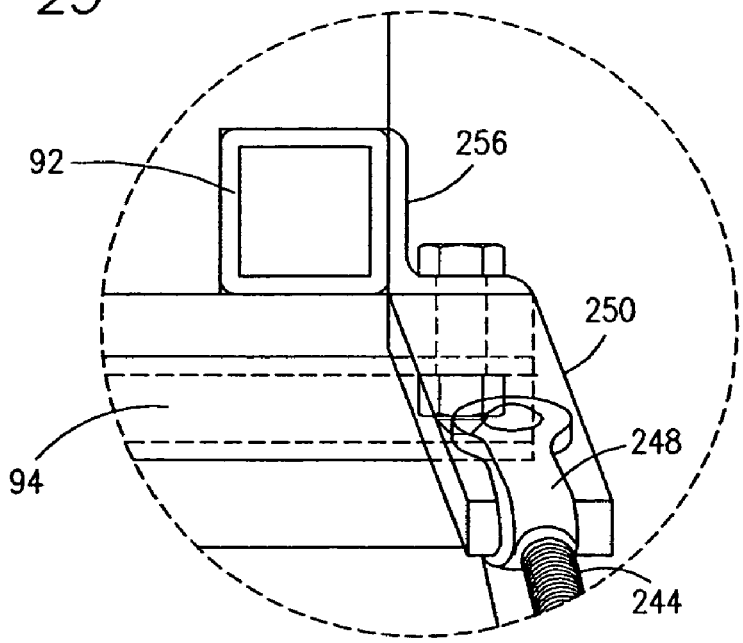
FIG. 24 in an enlarged view of the encircled portion of FIG. 23.

The embodiment shown in FIGS. 23 and 24 employs the same ground anchor 240 described above in connection with FIGS. 21 and 22, except it is adapted for use with slats 138 or beams 90, 92 (or beams 150) which are received within a seat in the side walls 20, 22 of the barrier device 10, such as shown in FIGS. 14 and 15C. In this embodiment, a mounting bracket 94 is inserted within the opening 72 formed in the barrier 10, as in the embodiment of FIG. 9. An L-shaped angle 256 is welded or otherwise affixed to the beam 92 or 150 (or slat 138), and the tubular connector 250 is secured by bolts between the angle 256 and mounting bracket 94. The ground anchor 240 functions in the same manner as described above to assist in stabilizing the barrier devices 10 atop the surface upon which they rest.

Figure 25:
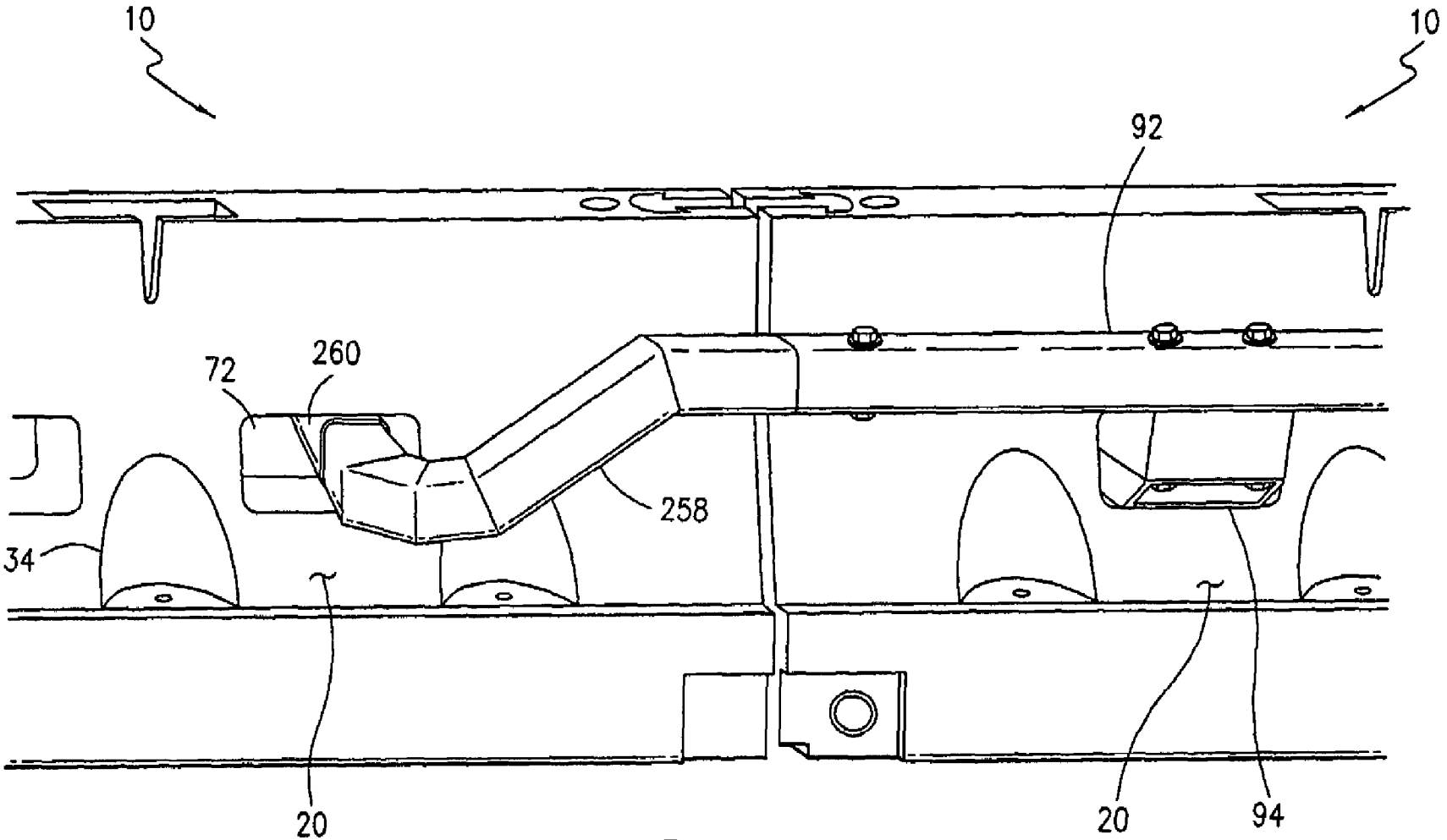
FIG. 25 is a side view of two barrier devices in a barrier wall in which an end connector is mounted to the beam carried by one of the barrier devices.

Referring now to FIG. 25, when a number of barrier devices 10 are connected end-to-end to form a barrier wall as described above, the barriers 10 at the outermost ends of the wall have beams 90, 92 or slats 138 with ends which are exposed. This can present a hazard to drivers, passengers and pedestrians in the event of an impact. To address this potential problem, a pair of end connectors 258 and 260 are provided. As depicted in FIG. 25, the end connector 258 has one end which is mounted to the beam 92, for example, on one side of the barrier 10, and the end connector 260 has an end mounted in the same manner to the beam 90 on the opposite side of the barrier 10 (not shown). The free ends of the two connectors 258 and 260 extend into the through bore 72 of another barrier device 10, which does not include external reinforcement structure, where such ends are connected together. As shown in FIG. 25, the end connectors 258 and 260 taper downwardly from their connection to the beams 90, 92, and then connect together within the bore 72, so as to avoid presenting a sharp end of a beam or slat toward oncoming vehicle or pedestrian traffic. Although the end connectors 258 and 260 are illustrated with the box beams 90 and 92, it should be understood that they may be employed with the box beams 119, 112, and the slats 138, 150, 214 and 226.

Flotation of Barrier Devices

With reference to FIG. 7, in one preferred embodiment of this invention structure is provided to allow the barrier devices 10 and 10' to float by resisting leakage of water within which the device 10 is placed into the hollow interior 24 of the barrier device 10. Each of the walls 12, 14, 16, 18, 20 and 22 is formed with an inner surface 130 located within the hollow interior 24 and an exterior, outer surface 132. These inner surfaces 130 receive a foam layer 134 having a thickness in the range of about 0.5 to 6 inches. The remainder of the hollow interior 24 is open and can be filled with ballast material through fill holes 33 in the manner described above. The foam layer 134 is effective to seal the inner surface 130 of each wall and substantially prevent leakage of water into the hollow interior 24. Additionally, the foam layer 134 is puncture resistant, particularly as its thickness is increased, and therefore resists leakage even if the plastic walls of the barrier are damaged by fork lifts or other equipment during transit or assembly of the barriers 10.

The method of forming the barrier device 10 with the foam layer 94 forms no part of this invention, and is therefore not discussed in detail herein. Generally, a rotational molding process is employed in which a polyethylene resin and polyethylene foaming pellets are combined in a mold to form the completed barrier. Each of the walls 12, 14, 16, 18, 20 and 22 is therefore formed of a high density polyethylene using this molding technique, preferably having a thickness on the order of about 0.25 inches. One type of polyethylene resin suitable for forming the plastic walls of the barrier 10 are commercially available from Exxon-Mobil Chemical under the trademark "PAXON," Type Numbers 7004 and 7204 rotational molding resins.

One foam material which can be employed in the rotational molding process noted above to form the foam layer 134 is commercially available from Equistar Chemicals, Inc. of Houston, Tex. under the trademark "PETROTHENE." A structural foam, semi-rigid foam or flexible PETROTHENE foam may be employed in the barrier 10 and 10' of this invention, whose properties and type numbers are as follows:

| Property | Nominal Value | Units |
|---|---|---|
| MSTR005 - Structural Foam | | |
| Density | 7 | $lb/ft^3$ |
| Compressive Modulus | 800 | psi |
| Shrinkage (w/MSTR003, 4 skin) | 0.010-0.015 | in/in |
| Thermal Conductivity (k) | 0.435 | BTU in/hr $ft^2$ ° F. |
| MSTR008 - Semi-Rigid Foam | | |
| Density | 4 | $lb/ft^3$ |
| Compressive Modulus | 180 | psi |
| Shrinkage (w/MSTR003, 4 skin) | 0.010-0.015 | in/in |
| Thermal Conductivity (k) | 0.384 | BTU in/hr $ft^2$ ° F. |
| MSTR007 - Flexible Foam | | |
| Density | 2 | $lb/ft^3$ |
| Compressive Modulus | 35 | psi |
| Shrinkage (w/MSTR003, 4 skin) | 0.010-0.015 | in/in |
| Thermal Conductivity (k) | 0.357 | BTU in/hr $ft^2$ ° F. |

In most instances it is contemplated that a semi-rigid foam would be employed to form the foam layer 134, such as PETROTHENE Type No. MSTR008, depending on the particular application for which the barrier device is intended. If additional structural rigidity is required, a denser foam with increased compressive modulus may be used such as PETROTHENE Type No. MSTR005. Further, the overall thickness of the foam layer 134 can be controlled in the molding process to increase or decrease the rigidity of the barrier 10, i.e., the thicker the foam layer 94 the more rigid the walls 12-22.

Referring now to FIG. 8, a further embodiment of this invention is shown in which the hollow interior 24 of the barrier 10 is completely filled with a foam material to form a solid foam body 136. One presently preferred foaming material is a two-component polyether-based, low density pour-in-place urethane foam commercially available from North Carolina Foam Industries of Mount Airy, N.C. under the name "NCFI Low Density Pour System 31-120." The resin properties and reaction properties of this material are as follows:

| TYPICAL RESIN PROPERTIES: | | |
|---|---|---|
| | 31-120R | 31-120A |
| Viscosity @ 72° F. | 500 cps | 200 cps |
| Weight Per Gallon | 9.5 lbs. | 10.2 lbs. |

-continued

| TYPICAL RESIN PROPERTIES: | | |
|---|---|---|
| | 31-120R | 31-120A |
| Appearance | amber liquid | brown liquid |
| Shelf Life | 6 months | 6 months |

| MIX RATIO: | | |
|---|---|---|
| | 31-120R | 31-120A |
| Ratio By Weight | 100 parts | 107 parts |
| Ratio By Volume | 100 parts | 100 parts |

| TYPICAL REACTION PROPERTIES: | |
|---|---|
| | Hand Mix @ 72° F. |
| Cream Time, seconds | 32 |
| Gel Time, seconds | 140 |
| Rise Time, seconds | 210 |
| Density (FRC) | 1.9 pcf |

As noted above and shown in FIGS. 4 and 9, adjacent barriers 10 can be connected end-to-end to form a barrier wall. With the barriers filled with foaming material to form a solid foam body 136 within the hollow interior 24, the individual barriers 10 and collectively formed barrier wall readily floats in water. Although the embodiment of the barrier 10 shown in FIG. 7 will also float, it is contemplated that that the provision of a foam body 136 within the barrier interior 24 will result in a more durable structure with better integrity in the event of impact with a vessel or other object. A barrier wall formed with individual barrier devices 10 and 10' of the type shown in FIG. 13 can be utilized in a variety of marine applications to encircle vessels and other objects in the water, as well as to prevent access to given areas within a port or docking area as desired. Further resistance to impact is provided with the addition of the external reinforcement structure shown in FIGS. 4-6 or 9-13, in combination with the barrier devices 10 including foam material depicted in FIGS. 7 and 8.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, while the barrier 10 of FIG. 8 is illustrated with a foam body 136 which substantially entirely occupies the volume of the hollow interior 24, a foam body of lesser volume could be employed. Additionally, the "external reinforcing structure" of this invention is characterized as a "beam" and depicted in the Figs. as either a hollow member having a generally square cross section (FIGS. 4-6, 9-13 and 15-15C) or a solid, substantially rectangular-shaped slat (FIGS. 14 and 14A). It should be understood that the term "beam" as used herein is not limited to the particular structures shown, but is meant to broadly include hollow and solid members of essentially any cross sectional shape as well as members whose outer surface includes openings such as a cage structure or the like.

Therefore, it is intended that the invention not be limited to the particular embodiment disclosed as the best mode contemplated for carrying out this invention, but that the invention will include all embodiments falling within the scope of the appended claims.

We claim:

1. A barrier wall, comprising:

a number of individual barrier devices each including:

(i) a top wall, a bottom wall, opposed end walls and opposed side walls interconnected to collectively form a hollow interior;

(ii) at least one opening extending through said hollow interior from one of said side walls to the other of said side walls;

(iii) a first beam extending along one of said side walls and a second beam extending along the other of said side walls, each of said first and second beams having opposite;

(iv) at least one mounting bracket extending through said at least one opening in said hollow interior, said at least one mounting bracket being mounted to said first beam and to said second beam to connect said first and second beams together along their respective side walls;

a clamping device located at each end of said first and second beams of each of said barrier devices, one of said clamping devices being connected between one end of a first beam of one barrier device and one end of a first beam of an adjacent barrier device, and another of said clamping devices being connected between one end of a second beam of one barrier device and one end of a second beam of an adjacent barrier device.

2. The barrier wall of claim 1 in which each of said clamping devices is a generally C-shaped clamp.

3. A barrier wall, comprising:

a number of barrier devices each including:

(i) a top wall, a bottom wall, opposed end walls and opposed side walls interconnected to collectively form a hollow interior;

(ii) at least one opening extending through said hollow interior from one of said side walls to the other of said side walls;

(iii) a first beam extending along one of said side walls and a second beam extending along the other of said side walls, each of said first and second beams having opposed ends;

(iv) at least one mounting bracket extending through said at least one opening in said hollow interior, said at least one mounting bracket being mounted to said first beam and to said second beam to connect said first and second beams together along their respective side walls;

adjacent barrier devices being connected together end-to-end to form wall, an end-most barrier device being located at one end of said wall and having a first beam and a second beam each with an exposed end;

a pair of end connectors each having opposed ends, one end of each of said end connectors being connected to said exposed end of one of said first and second beams of said end-most barrier device, said opposite ends of said end connectors being mounted to one another.

* * * * *